US009119011B2

(12) United States Patent
Chabanne et al.

(10) Patent No.: US 9,119,011 B2
(45) Date of Patent: Aug. 25, 2015

(54) UPMIXING OBJECT BASED AUDIO

(75) Inventors: Christophe Chabanne, Carpentras (FR); Charles Q. Robinson, Piedmont, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 127 days.

(21) Appl. No.: 14/125,917

(22) PCT Filed: Jun. 27, 2012

(86) PCT No.: PCT/US2012/044345

§ 371 (c)(1), (2), (4) Date: Dec. 12, 2013

(87) PCT Pub. No.: WO2013/006325

PCT Pub. Date: Jan. 10, 2013

(65) Prior Publication Data

US 2014/0133682 A1 May 15, 2014

Related U.S. Application Data

(60) Provisional application No. 61/504,005, filed on Jul. 1, 2011, provisional application No. 61/635,930, filed on Apr. 20, 2012.

(51) Int. Cl.

| | |
|---|---|
| ***H04R 5/02*** | (2006.01) |
| ***H04S 7/00*** | (2006.01) |
| ***H04S 3/00*** | (2006.01) |

(52) U.S. Cl.

CPC .. *H04S 7/30* (2013.01); *H04R 5/02* (2013.01); *H04S 3/002* (2013.01); *H04S 2400/11* (2013.01)

(58) Field of Classification Search

CPC ..... H04R 5/02; H04S 3/00

USPC ..... 381/300

See application file for complete search history.

(56) References Cited

U.S. PATENT DOCUMENTS

| | | | |
|---|---|---|---|
| 5,768,393 | A | 6/1998 | Mukojima et al. |
| 6,078,669 | A | 6/2000 | Maher |

(Continued)

FOREIGN PATENT DOCUMENTS

| | | |
|---|---|---|
| JP | 8-140199 | 5/1996 |
| JP | H11-331995 | 11/1999 |

(Continued)

OTHER PUBLICATIONS

Stanojevic, T. et al "The Total Surround Sound System", 86th AES Convention, Hamburg, Mar. 7-10, 1989.

Stanojevic, T. et al "Designing of TSS Halls" 13th International Congress on Acoustics, Yugoslavia, 1989.

Stanojevic, T. et al "TSS System and Live Performance Sound" 88th AES Convention, Montreux, Mar. 13-16, 1990.

(Continued)

*Primary Examiner* — Simon King

(57) ABSTRACT

In some embodiments, a method for rendering an object based audio program indicative of a trajectory of an audio source, including by generating speaker feeds for driving loudspeakers to emit sound intended to be perceived as emitting from the source, but with the source having a different trajectory than that indicated by the program. In other embodiments, a method for modifying (upmixing) an object based audio program indicative of a trajectory of an audio object within a subspace of a full volume, to determine a modified program indicative of a modified trajectory of the object such that at least a portion of the modified trajectory is outside the subspace. Other aspects include a system configured to perform, and a computer readable medium which stores code for implementing, any embodiment of the inventive method.

27 Claims, 2 Drawing Sheets

(56) References Cited

U.S. PATENT DOCUMENTS

| | | | | |
|---|---|---|---|---|
| 7,590,249 | B2 | 9/2009 | Jang et al. | |
| 2006/0117261 | A1 | 6/2006 | Sim et al. | |
| 2006/0133628 | A1* | 6/2006 | Trivi et al. | 381/310 |
| 2007/0269063 | A1 | 11/2007 | Goodwin et al. | |
| 2008/0205658 | A1 | 8/2008 | Breebaart | |
| 2009/0034764 | A1 | 2/2009 | Ohashi | |
| 2009/0116652 | A1 | 5/2009 | Kirkeby | |
| 2009/0129603 | A1 | 5/2009 | Cho | |
| 2009/0136044 | A1 | 5/2009 | Xiang | |
| 2012/0022842 | A1 | 1/2012 | Amadu | |

FOREIGN PATENT DOCUMENTS

| | | |
|---|---|---|
| JP | 2002-354598 | 12/2002 |
| JP | 2004-193877 | 7/2004 |
| JP | 2007-194900 | 8/2007 |
| RS | 1332 U | 8/2013 |
| WO | 97/49262 | 12/1997 |
| WO | 2010/027882 | 3/2010 |
| WO | 2010/080451 | 7/2010 |
| WO | 2011/048067 | 4/2011 |
| WO | 2011/073210 | 6/2011 |
| WO | 2012/025580 | 3/2012 |

OTHER PUBLICATIONS

Stanojevic, Tomislav "3-D Sound in Future HDTV Projection Systems" presented at the 132nd SMPTE Technical Conference, Jacob K. Javits Convention Center, New York City, Oct. 13-17, 1990.

Stanojevic, T. "Some Technical Possibilities of Using the Total Surround Sound Concept in the Motion Picture Technology", 133rd SMPTE Technical Conference and Equipment Exhibit, Los Angeles Convention Center, Los Angeles, California, Oct. 26-29, 1991.

Stanojevic, T. et al. "TSS Processor" 135th SMPTE Technical Conference, Oct. 29-Nov. 2, 1993, Los Angeles Convention Center, Los Angeles, California, Society of Motion Picture and Television Engineers.

Stanojevic, Tomislav, "Virtual Sound Sources in the Total Surround Sound System" Proc. 137th SMPTE Technical Conference and World Media Expo, Sep. 6-9, 1995, New Orleans Convention Center, New Orleans, Louisiana.

Stanojevic, T. et al "The Total Surround Sound (TSS) Processor" SMPTE Journal, Nov. 1994.

Stanojevic, Tomislav "Surround Sound for a New Generation of Theaters, Sound and Video Contractor" Dec. 20, 1995.

* cited by examiner

UPMIXING OBJECT BASED AUDIO

CROSS-REFERENCE OF RELATED APPLICATIONS

This application claims priority to U.S. Provisional Application No. 61/504,005 filed 1 Jul. 2011 and U.S. Provisional Application No. 61/635,930 filed 20 Apr. 2012, all of which are hereby incorporated by reference in entirety for all purposes.

TECHNICAL FIELD

The invention relates to systems and methods for upmixing (or otherwise modifying an audio object trajectory determined by) object based audio (i.e., audio data indicative of an object based audio program) to generate modified data (i.e., data indicative of a modified version of the audio program) from which multiple speaker feeds can be generated. In some embodiments, the invention is a system and method for rendering object based audio to generate speaker feeds for driving sets of loudspeakers, including by performing upmixing on the object based audio.

BACKGROUND

Conventional channel-based audio encoders typically operate under the assumption that each audio program (that is output by the encoder) will be reproduced by an array of loudspeakers in predetermined positions relative to a listener. Each channel of the program is a speaker channel. This type of audio encoding is commonly referred to as channel-based audio encoding.

Another type of audio encoder (known as an object-based audio encoder) implements an alternative type of audio coding known as audio object coding (or object based coding and operates under the assumption that each audio program (that is output by the encoder) may be rendered for reproduction by any of a large number of different arrays of loudspeakers. Each audio program output by such an encoder is an object based audio program, and typically, each channel of such object based audio program is an object channel. In audio object coding, audio signals associated with distinct sound sources (audio objects) are input to the encoder as separate audio streams. Examples of audio objects include (but are not limited to) a dialog track, a single musical instrument, and a jet aircraft. Each audio object is associated with spatial parameters, which may include (but are not limited to) source position, source width, and source velocity and/or trajectory. The audio objects and associated parameters are encoded for distribution and storage. Final audio object mixing and rendering is performed at the receive end of the audio storage and/or distribution chain, as part of audio program playback. The step of audio object mixing and rendering is typically based on knowledge of actual positions of loudspeakers to be employed to reproduce the program.

Typically, during generation of an object based audio program, the content creator embeds the spatial intent of the mix (e.g., the trajectory of each audio object determined by each object channel of the program) by including metadata in the program. The metadata can be indicative of the position or trajectory of each audio object determined by each object channel of the program, and/or at least one of the size, velocity, type (e.g., dialog or music), and another characteristic of each such object.

During rendering of an object based audio program, each object channel can be rendered ("at" a time-varying position having a desired trajectory) by generating speaker feeds indicative of content of the channel and applying the speaker feeds to a set of loudspeakers (where the physical position of each of the loudspeakers may or may not coincide with the desired position at any instant of time). The speaker feeds for a set of loudspeakers may be indicative of content of multiple object channels (or a single object channel). The rendering system typically generates the speaker feeds to match the exact hardware configuration of a specific reproduction system (e.g., the speaker configuration of a home theater system, where the rendering system is also an element of the home theater system).

In the case that an object based audio program indicates a trajectory of an audio object, the rendering system would typically generate speaker feeds for driving a set of loudspeakers to emit sound intended to be perceived (and which typically will be perceived) as emitting from an audio object having said trajectory. For example, the program may indicate that sound from a musical instrument (an object) should pan from left to right, and the rendering system might generate speaker feeds for driving a 5.1 array of loudspeakers to emit sound that will be perceived as panning from the L (left front) speaker of the array to the C (center front) speaker of the array and then the R (right front) speaker of the array. Herein, "trajectory" of an audio object (indicated by an object based audio program) is used in a broad sense to denote the position or positions (e.g., position as a function of time) from which sound emitted during rendering of the program is the object is intended to be perceived as emitting. Thus, a trajectory could consist of a single, stationary point (or other position), or it could be a sequence of positions, or it could be a point (or other position) which varies as a function of time.

However, until the present invention it had not been known how to render an object based audio program (which is indicative of a trajectory of an audio source) by generating speaker feeds for driving a set of loudspeakers to emit sound intended to be perceived as emitting from the source but with said source having a different trajectory than the one indicated by the program. Typical embodiments of the invention are methods and systems for rendering an object based audio program (which is indicative of a trajectory of an audio source), including by efficiently generating speaker feeds for driving a set of loudspeakers to emit sound intended to be perceived as emitting from the source but with said source having a different trajectory than the one indicated by the program (e.g., with said source having a trajectory in a vertical plane, or a three-dimensional trajectory, where the program indicates the source's trajectory is in a horizontal plane).

There are many conventional methods for rendering audio programs in systems that employ channel-based audio encoding. For example, conventional upmixing techniques could be implemented during rendering of the audio programs (comprising speaker channels) which are indicative of sound from sources moving along trajectories within a subspace of a full three-dimensional volume (e.g., trajectories which are along horizontal lines), to generate speaker feeds for driving speakers positioned outside this subspace. Such upmixing techniques are based on phase and amplitude information included in the program to be rendered, whether this information was intentionally coded (in which case the upmixing can be implemented by matrix encoding/decoding with steering) or is naturally contained in the speaker channels of the program (in which case the upmixing is blind upmixing). Thus, the conventional phase/amplitude-based upmixing techniques which have been applied to audio programs comprising speaker channels are subject to a number of limitations and disadvantages, including the following:

whether the content is matrix encoded or not, they generate a significant amount of crosstalk across speakers;

in the case of blind upmixing, the risk of panning a sound in a non-coherent way with video is greatly increased, and the typical way to lower this risk is to upmix only what appears to be non-directional elements of the program (typically decorrelated elements); and they often create artifacts either by limiting the steering logic to wide band, often making the sound collapse during reproduction, or by applying a multiband steering logic that creates a spatial smearing of the frequency bands of a unique sound (sometimes referred to as "the gargling effect").

Even if conventional phase/amplitude-based techniques for upmixing audio programs comprising speaker channels (to generate upmixed programs having more speaker channels than the input programs) were somehow applied to object based audio programs (to generate speaker feeds for more loudspeakers than could be generated from the input programs without the upmixing), this would result in a loss of perceived discreteness (of the audio objects indicated by the upmixed programs) and/or would generate artifacts of the type described above. Thus, systems and related methods are needed for rectifying the deficiencies noted above.

BRIEF DESCRIPTION OF EXEMPLARY EMBODIMENTS

Typical embodiments of the invention are methods for rendering an object based audio program (which is indicative of a trajectory of an audio source), including by generating speaker feeds for driving a set of loudspeakers to emit sound intended to be perceived as emitting from the source, but with the source having a different trajectory than the one indicated by the program (e.g., with the source having a trajectory in a vertical plane or a three-dimensional trajectory, where the program indicates a source trajectory in a horizontal plane). The term "trajectory" of an audio object (indicated by an object based audio program) is used herein in a broad sense to denote the position or positions (e.g., position as a function of time) from which sound emitted during rendering of the program is the object is intended to be perceived as emitting. Thus, a trajectory could consist of a single, stationary position, or it could be a sequence of positions, or it could be a point (or other position) which varies as a function of time.

In some embodiments, the invention is a method for rendering an object based audio program for playback by a set of loudspeakers, where the program is indicative of a trajectory of an audio object, and the trajectory is within a subspace of a full three-dimensional volume (e.g., the trajectory is limited to be in a horizontal plane within the volume, or is a horizontal line within the volume). The method includes the steps of modifying the program to determine a modified program indicative of a modified trajectory of the object (e.g., by modifying coordinates of the program indicative of the trajectory), where at least a portion of the modified trajectory is outside the subspace (e.g., where the trajectory is a horizontal line, the modified trajectory is a path in a vertical plane including the horizontal line); and generating speaker feeds in response to the modified program, such that the speaker feeds include at least one feed for driving at least one speaker in the set whose position corresponds to a position outside the subspace and feeds for driving speakers in the set whose positions correspond to positions within the subspace.

In other embodiments, the inventive method includes a step of modifying an object based audio program indicative of a trajectory of an audio object, to determine a modified program indicative of a modified trajectory of the object, where both the trajectory and the modified trajectory are defined in the same space (i.e., no portion of the modified trajectory extends outside the space in which the trajectory extends). For example, the trajectory may be modified to optimize (or otherwise modify) the timbre of sound emitted in response to speaker feeds determined from the modified program relative to the sound that would be emitted in response to speaker feeds determined from the original program (e.g., in the case that the modified trajectory, but not the original trajectory, determines a single ended "snap to" or "snap toward" a speaker).

Typically, the object based audio program (unless it is modified in accordance with the invention) is capable of being rendered to generate only speaker feeds for driving a subset of the set of loudspeakers (e.g., only those speakers in the set whose positions correspond to the subspace of the full three-dimensional volume). For example, the audio program may be capable of being rendered to generate only speaker feeds for driving the speakers in the set which are positioned in a horizontal plane including the listener's ears, where the subspace is said horizontal plane. The inventive rendering method can implement upmixing by generating at least one speaker feed (in response to the modified program) for driving a speaker in the set whose position corresponds to a position outside the subspace, as well as generating speaker feeds for driving speakers in the set whose positions correspond to positions within the subspace. For example, one embodiment of the method includes a step of generating speaker feeds in response to the modified program for driving all the loudspeakers of the set. Thus, this embodiment leverages all speakers present in the playback system, whereas rendering of the original (unmodified) program would not generate speaker feeds for driving all the speakers of the playback system.

In typical embodiments, the method includes steps of distorting over time a trajectory of an authored object to determine a modified trajectory of the object, where the object's trajectory is indicated by an object based audio program and is within a subspace of a three-dimensional volume, and such that at least a portion of the modified trajectory is outside the subspace, and generating at least one speaker feed for a speaker whose position corresponds to a position outside the subspace (e.g., a speaker feed for a speaker located at a nonzero elevational angle relative to a listener, where the subspace is a horizontal plane at an elevational angle of zero relative to the listener). For example, the method may include a step of distorting an audio object's trajectory indicated by an object based audio program, where the trajectory is in a horizontal plane at an elevational angle of zero relative to the listener, in order to generate a speaker feed for a speaker (of a playback system) located at a nonzero elevational angle relative to a listener, where none of the speakers of the original authoring speaker system was located at a nonzero elevational angle relative to the content creator.

In some embodiments, the inventive method includes the step of modifying (upmixing) an object based audio program indicative of a trajectory of an audio object, and the trajectory is within a subspace of a full three-dimensional volume, to determine a modified program indicative of a modified trajectory of the object (e.g., by modifying coordinates of the program indicative of the trajectory, where such coordinates are determined by metadata included in the program), such that at least a portion of the modified trajectory is outside the subspace. Some such embodiments are implemented by a stand-alone system or device (an "upmixer"). The modified program determined by the upmixer's output is typically provided to a rendering system configured to generate speaker feeds (in response to the modified program) for driving a set of loudspeakers, typically including a speaker feed for driving at least one speaker in the set whose position corresponds to a position outside the subspace. Alternatively, some such embodiments of the inventive method are implemented by a rendering system which generates the modified program and generates speaker feeds (in response to the modified program) for driving a set of loudspeakers, typically including a speaker feed for driving at least one speaker in the set whose position corresponds to a position outside the subspace.

Some embodiments of the method implement both audio object trajectory modification and rendering in a single step. For example, the rendering could implicitly distort (modify) a trajectory (of an audio object) determined by an object based audio program (to determine a modified trajectory for the object) by explicit generation of speaker feeds for speakers having distorted versions of known positions (e.g., by explicit distortion of known loudspeaker positions). The distortion could be implemented as a scale factor applied to an axis (e.g., a height axis). For example, application of a first scale factor (e.g., a scale factor equal to 0.0) to the height axis of a trajectory during generation of speaker feeds could cause the modified trajectory to intersect the position of an overhead speaker (resulting in "100% distortion"), so that the sound emitted from the speakers of the playback system in response to the speaker feeds would be perceived as emitting from a source whose (modified) trajectory includes the location of the overhead speaker. Application of a second scale factor (e.g., a scale factor greater than 0.0 but not greater than 1.0) to the height axis of the trajectory during generation of speaker feeds could cause the modified trajectory to approach (but not intersect) the position of the overhead speaker more closely than does the original trajectory (resulting in "X % distortion," where the value of X is determined by the value of the scale factor), so that the sound emitted from the speakers of the playback system in response to the speaker feeds would be perceived as emitting from a source whose (modified) trajectory approaches (but does not include) the location of the overhead speaker. Application of a third scale factor (e.g., a scale factor greater than 1.0) to the height axis of the trajectory during generation of speaker feeds could cause the modified trajectory to diverge from the position of the overhead speaker (farther than the original trajectory does). Combined trajectory modification and speaker feed generation can be implemented without any need to determine an inflection point, or to implement look ahead.

Typically, the playback system includes a set of loudspeakers, and the set includes a first subset of speakers at known positions in a first space corresponding to positions in the subspace containing the object trajectory indicated by the audio program to be rendered (e.g., loudspeakers at positions nominally in a horizontal plane including the listener's ears, where the subspace is a horizontal plane including the listener's ears), and a second subset including at least one speaker, where each speaker in the second subset is at a known position corresponding to a position outside the subspace. To determine the modified trajectory (which is typically, but not necessarily, a curved trajectory), the rendering method may determine a candidate trajectory. The candidate trajectory may include a start point in the first space (such that one or more speakers in the first subset can be driven to emit sound perceived as originating at the start point) which coincides with a start point of the object trajectory, an end point in the first space (such that one or more speakers in the first subset can be driven to emit sound perceived as originating at the end point) which coincides with an end point of the object trajectory, and at least one intermediate point corresponding to the position of a speaker in the second subset (such that, for each intermediate point, a speaker in the second subset can be driven to emit sound perceived as originating at said intermediate point). In some cases, the candidate trajectory is used as the modified trajectory.

In other cases, a distorted version of the candidate trajectory (determined by distorting the candidate trajectory by applying at least one distortion coefficient thereto) is used as the modified trajectory. Each distortion coefficient's value determines a degree of distortion applied to the candidate trajectory. For example, in one embodiment, the projection of each intermediate point (along the candidate trajectory) on the first space defines an inflection point (in the first space) which corresponds to the intermediate point. The line (normal to the first space) between the intermediate point and the corresponding inflection point is referred to as a distortion axis for the intermediate point. A distortion coefficient (for each intermediate point), whose value indicates position along the distortion axis for the intermediate point, determines a modified version of the intermediate point. Using such a distortion coefficient for each intermediate point, the modified trajectory may be determined to be a trajectory which extends from the start point of the candidate trajectory, through the modified version of each intermediate point, to the end point of the candidate trajectory. Because the modified trajectory determines (with the audio content for the relevant object) each speaker feed for the relevant object channel, each distortion coefficient controls how close the rendered object will be perceived to get to the corresponding speaker (in the second subset) when the rendered object pans along the modified trajectory.

In the case that the inventive system (either a rendering system, or an upmixer for generating a modified program for rendering by a rendering system) is configured to process content in a non-real-time manner, it is useful to include metadata in an object based audio program to be rendered, where the metadata indicates both the starting and finishing points for each object trajectory indicated by the program, and to configure the system to use such metadata to implement upmixing (to determine a modified trajectory for each such trajectory) without need for look-ahead delays. Alternatively, the need for look-ahead delays could be eliminated by configuring the inventive system to average over time the coordinates of an object trajectory (indicated by an object based audio program to be rendered) to generate a trajectory trend and to use such averages to predict the path of the trajectory and find each inflection point of the trajectory.

Additional metadata could be included in an object based audio program, to provide to the inventive system (either a system configured to render the program, or an upmixer for generating a modified version of the program for rendering by a rendering system) information that enables the system to override a coefficient value or otherwise influences the system's behavior (e.g., to prevent the system from modifying the trajectories of certain objects indicated by the program). For example, the metadata could indicate a characteristic (e.g., a type or a property) of an audio object, and the system could be configured to operate in a specific mode in response to such metadata (e.g., a mode in which it is prevented from modifying the trajectory of an object of a specific type). For example, the system could be configured to respond to metadata indicating that an object is dialog, by disabling upmixing for the object (e.g., so that speaker feeds will be generated using the trajectory, if any, indicated by the program for the dialog, rather than from a modified version of the trajectory, e.g., one which extends above or below the horizontal plane of the intended listener's ears).

In a class of embodiments, the inventive rendering system is configured to determine, from an object based audio program (and knowledge of the positions of the speakers to be employed to play the program), the distance between each position of an audio source indicated by the program and the position of each of the speakers. The positions of the speakers can be considered to be desired positions of the source (if it is desired to render a modified version of the program so that the emitted sound is perceived as emitting from positions that include positions at or near all the speakers of the playback system), and the source positions indicated by the program can be considered to be actual positions of the source. The system is configured in accordance with the invention to determine, for each actual source position (e.g., each source position along a source trajectory) indicated by the program, a subset of the full set of speakers (a "primary" subset) consisting of those speakers of the full set which are (or the speaker of the full set which is) closest to the actual source position, where "closest" in this context is defined in some reasonably defined sense (e.g., the speakers of the full set which are "closest" to a source position may be each speaker whose position in the playback system corresponds to a position, in the three dimensional volume in which the source's trajectory is defined, whose distance from the source position is within a predetermined threshold value, or whose distance from the source position satisfies some other predetermined criterion). Typically, speaker feeds are generated (for each source position) which cause sound to be emitted with relatively large amplitudes from the speaker(s) of the primary subset (for the source position) and with relatively smaller amplitudes (or zero amplitudes) from the other speakers of the playback system.

A sequence of source positions indicated by the program (which can be considered to define a source trajectory) determines a sequence of primary subsets of the full set of speakers (one primary subset for each source position in the sequence).

The positions of the speakers in each primary subset define a three-dimensional (3D) space which contains each speaker of the primary subset and the relevant actual source position (but contains no other speaker of the full set). The steps of determining a modified trajectory (in response to a source trajectory indicated by the program) and generating speaker feeds (for driving all speakers of the playback system) in response to the modified trajectory, can thus be implemented in the exemplary rendering system as follows: for each of the sequence of source positions indicated by the program (which can be considered to define a trajectory, e.g., the "original trajectory" of FIG. 3), speaker feeds are generated for driving the speaker(s) of the corresponding primary subset (included in the 3D space for the source position), and the other speakers of the full set, to emit sound intended to be perceived (and which typically will be perceived) as being emitted by the source from a characteristic point of the 3D space (e.g., the characteristic point may be the intersection of the top surface of the 3D space with a vertical line through the source position determined by the program). Considering the sequence of 3D spaces so determined from an object based audio program, and identifying the characteristic point of each of the 3D spaces in the sequence, a curve that is fitted through all or some of the characteristic points can be considered to define a modified trajectory (determined in response to the original trajectory indicated by the program).

Optionally, a scaling parameter is applied to each of the 3D spaces (which are determined in accordance with an embodiment in the noted class) to generate a scaled space (sometimes referred to herein as a "warped" space) in response to the 3D space, and speaker feeds are generated for driving the speakers (of the full set employed to play the program) to emit sound intended to be perceived (and which typically will be perceived) as being emitted by the source from a characteristic point of the warped space rather than from the above-noted characteristic point of the 3D space (e.g., the characteristic point of the warped space may be the intersection of the top surface of the warped space with a vertical line through the source position determined by the program). The warping could be implemented as a scale factor applied to a height axis, so that the height of each warped space is a scaled version of the height of the corresponding 3D space.

Aspects of the invention include a system (e.g., an upmixer or a rendering system) configured (e.g., programmed) to perform any embodiment of the inventive method, and a computer readable medium (e.g., a disc or other tangible object) which stores code for implementing any embodiment of the inventive method.

In some embodiments, the inventive system is or includes a general or special purpose processor programmed with software (or firmware) and/or otherwise configured to perform an embodiment of the inventive method. In some embodiments, the inventive system is or includes a general purpose processor, coupled to receive input audio (and optionally also input video), and programmed to generate (by performing an embodiment of the inventive method) output data (e.g., output data determining speaker feeds) in response to the input audio. In other embodiments, the inventive system is implemented as an appropriately configured (e.g., programmed and otherwise configured) audio digital signal processor (DSP) which is operable to generate output data (e.g., output data determining speaker feeds) in response to input audio.

Notation and Nomenclature

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X-M inputs are received from an external source) may also be referred to as a decoder system.

Throughout this disclosure including in the claims, the following expressions have the following definitions:

speaker and loudspeaker are used synonymously to denote any sound-emitting transducer. This definition includes loudspeakers implemented as multiple transducers (e.g., woofer and tweeter);

speaker feed: an audio signal to be applied directly to a loudspeaker, or an audio signal that is to be applied to an amplifier and loudspeaker in series;

channel (or "audio channel"): a monophonic audio signal;

speaker channel (or "speaker-feed channel"): an audio channel that is associated with a named loudspeaker (at a desired or nominal position), or with a named speaker zone within a defined speaker configuration. A speaker channel is rendered in such a way as to be equivalent to application of the audio signal directly to the named loudspeaker (at the desired or nominal position) or to a speaker in the named speaker zone;

object channel: an audio channel indicative of sound emitted by an audio source (sometimes referred to as an audio "object"). Typically, an object channel determines a parametric audio source description. The source description may determine sound emitted by the source (as a function of time), the apparent position (e.g., 3D spatial coordinates) of the source as a function of time, and optionally also other at least one additional parameter (e.g., apparent source size or width) characterizing the source;

audio program: a set of one or more audio channels (at least one speaker channel and/or at least one object channel) and optionally also associated metadata that describes a desired spatial audio presentation;

object based audio program: an audio program comprising a set of one or more object channels (and typically not comprising any speaker channel) and optionally also associated metadata that describes a desired spatial audio presentation (e.g., metadata indicative of a trajectory of an audio object which emits sound indicated by an object channel);

render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)). An audio channel can be trivially rendered ("at" a desired position) by applying a speaker feed indicative of content of the channel directly to a physical loudspeaker at the desired position, or one or more audio channels can be rendered using one of a variety of virtualization techniques designed to be substantially equivalent (for the listener) to such trivial rendering. In this latter case, each audio channel may be converted to one or more speaker feeds to be applied to loudspeaker(s) in known locations, which are in general different from the desired position, such that sound emitted by the loudspeaker(s) in response to the feed(s) will be perceived as emitting from the desired position. Examples of such virtualization techniques include binaural rendering via headphones (e.g., using Dolby Headphone processing which simulates up to 7.1 channels of surround sound for the headphone wearer) and wave field synthesis. An object channel can be rendered ("at" a time-varying position having a desired trajectory) by applying speaker feeds indicative of content of the channel to a set of physical loudspeakers (where the physical position of each of the loudspeakers may or may not coincide with the desired position at any instant of time);

azimuth (or azimuthal angle): the angle, in a horizontal plane, of a source relative to a listener/viewer. Typically, an azimuthal angle of 0 degrees denotes that the source is directly in front of the listener/viewer, and the azimuthal angle increases as the source moves in a counter clockwise direction around the listener/viewer;

elevation (or elevational angle): the angle, in a vertical plane, of a source relative to a listener/viewer. Typically, an elevational angle of 0 degrees denotes that the source is in the same horizontal plane as the listener/viewer (e.g., the ears of the listener/viewer), and the elevational angle increases as the source moves upward (in a range from 0 to 90 degrees) relative to the listener/viewer;

L: Left front audio channel. A speaker channel, typically intended to be rendered by a speaker positioned at about 30 degrees azimuth, 0 degrees elevation;

C: Center front audio channel. A speaker channel, typically intended to be rendered by a speaker positioned at about 0 degrees azimuth, 0 degrees elevation;

R: Right front audio channel. A speaker channel, typically intended to be rendered by a speaker positioned at about −30 degrees azimuth, 0 degrees elevation;

Ls: Left surround audio channel. A speaker channel, typically intended to be rendered by a speaker positioned at about 110 degrees azimuth, 0 degrees elevation;

Rs: Right surround audio channel. A speaker channel, typically intended to be rendered by a speaker positioned at about −110 degrees azimuth, 0 degrees elevation;

Full Range Channels: All audio channels of an audio program other than each low frequency effects channel of the program. Typical full range channels are L and R channels of stereo programs, and L, C, R, Ls and Rs channels of surround sound programs. The sound determined by a low frequency effects channel (e.g., a subwoofer channel) comprises frequency components in the audible range up to a cutoff frequency, but does not include frequency components in the audible range above the cutoff frequency (as do typical full range channels);

Front Channels: speaker channels (of an audio program) associated with frontal sound stage. Typical front channels are L and R channels of stereo programs, or L, C and R channels of surround sound programs; and AVR: an audio video receiver. For example, a receiver in a class of consumer electronics equipment used to control playback of audio and video content, for example in a home theater.

DETAILED DESCRIPTION OF EXEMPLARY EMBODIMENTS

Figure 1:
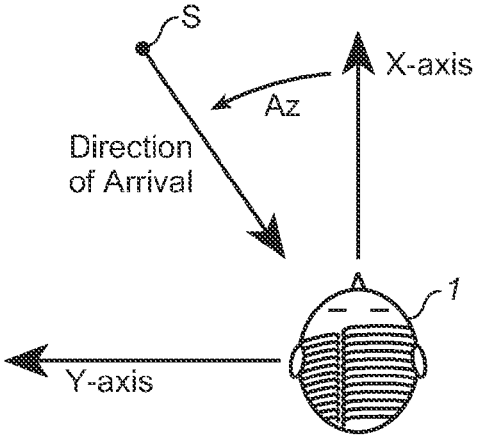
FIG. 1 is a diagram showing the definition of an arrival direction of sound (at listener 1's ears) in terms of an (x,y,z) unit vector, where the z axis is perpendicular to the plane of FIG. 1, and in terms of Azimuth angle Az (with an Elevation angle, El, equal to zero) in accordance with an embodiment of the invention.

Exemplary embodiments are directed to systems and methods that implement a type of audio coding called audio object coding (or object based coding or "scene description"), and operate under the assumption that each audio program (that is output by the encoder) may be rendered for reproduction by any of a large number of different arrays of loudspeakers. Each audio program output by such an encoder is an object based audio program, and typically, each channel of such object based audio program is an object channel. In audio object coding, audio signals associated with distinct sound sources (audio objects) are input to the encoder as separate audio streams. Examples of audio objects include (but are not limited to) a dialog track, a single musical instrument, and a jet aircraft. Each audio object is associated with spatial parameters, which may include (but are not limited to) source position, source width, and source velocity and/or trajectory. The audio objects and associated parameters are encoded for distribution and storage. Final audio object mixing and rendering may be performed at the receive end of the audio storage and/or distribution chain, as part of audio program playback. The step of audio object mixing and rendering is typically based on knowledge of actual positions of loudspeakers to be employed to reproduce the program.

Typically, during generation of an object based audio program, the content creator may embed the spatial intent of the mix (e.g., the trajectory of each audio object determined by each object channel of the program) by including metadata in the program. The metadata can be indicative of the position or trajectory of each audio object determined by each object channel of the program, and/or at least one of the size, velocity, type (e.g., dialog or music), and another characteristic of each such object.

During rendering of an object based audio program, each object channel can be rendered ("at" a time-varying position having a desired trajectory) by generating speaker feeds indicative of content of the channel and applying the speaker feeds to a set of loudspeakers (where the physical position of each of the loudspeakers may or may not coincide with the desired position at any instant of time). The speaker feeds for a set of loudspeakers may be indicative of content of multiple object channels (or a single object channel). The rendering system typically generates the speaker feeds to match the exact hardware configuration of a specific reproduction system (e.g., the speaker configuration of a home theater system, where the rendering system is also an element of the home theater system).

In the case that an object based audio program indicates a trajectory of an audio object, the rendering system would typically generate speaker feeds for driving a set of loudspeakers to emit sound intended to be perceived (and which typically will be perceived) as emitting from an audio object having said trajectory. For example, the program may indicate that sound from a musical instrument (an object) should pan from left to right, and the rendering system might generate speaker feeds for driving a 5.1 array of loudspeakers to emit sound that will be perceived as panning from the L (left front) speaker of the array to the C (center front) speaker of the array and then the R (right front) speaker of the array.

Audio object coding allows an object based audio program (sometimes referred to herein as a mix) to be played on any speaker configuration. Some embodiments for rendering an object based audio program assume that each audio object determined by the program is positioned in a space (e.g., moves along a trajectory in the space) which matches the space in which the speakers of the loudspeaker array to be employed to reproduce the program are located. For example, if an object based audio program indicates an object moving in a panning plane defined by a panning axis (e.g., a horizontally oriented front-back axis, a horizontally oriented left-right axis, a vertically oriented up-down axis, or near-far axis) and a listener, the rendering system would conventionally generate speaker feeds (in response to the program) for a loudspeaker array consisting of speakers nominally positioned in a plane parallel to the panning plane (i.e., the speakers are nominally in a horizontal plane if the panning plane is a horizontal plane).

Many embodiments of the present invention are technologically possible. It will be apparent to those of ordinary skill in the art from the present disclosure how to implement them. Embodiments of the inventive system, method, and medium will be described with reference to FIGS. 1-6. While some embodiments are directed towards ecosystems employing only audio object encoding, other embodiments are directed towards audio encoding ecosystems that are a hybrid between conventional channel-based encoding and audio objects encoding, borrowing characteristics of both types of encoding systems. For example, an object based audio program may include a set of one or more object channels (with accompanying metadata) and a set of one or more speaker channels.

Typical embodiments of the invention are methods for rendering an object based audio program (which is indicative of a trajectory of an audio source), including by generating speaker feeds for driving a set of loudspeakers to emit sound intended to be perceived as emitting from the source, but with the source having a different trajectory than the one indicated by the program (e.g., with the source having a trajectory in a vertical plane or a three-dimensional trajectory, where the program indicates a source trajectory in a horizontal plane).

In some embodiments, the invention is a method for rendering an object based audio program for playback by a set of loudspeakers, where the program is indicative of a trajectory of an audio object, and the trajectory is within a subspace of a full three-dimensional volume (e.g., the trajectory is limited to be in a horizontal plane within the volume, or is a horizontal line within the volume). The method includes the steps of modifying the program to determine a modified program indicative of a modified trajectory of the object (e.g., by modifying coordinates of the program indicative of the trajectory), where at least a portion of the modified trajectory is outside the subspace (e.g., where the trajectory is a horizontal line, the modified trajectory is a path in a vertical plane including the horizontal line); and generating speaker feeds (in response to the modified program) for driving at least one speaker in the set whose position corresponds to a position outside the subspace and for driving speakers in the set whose positions correspond to positions within the subspace.

Typically, the object based audio program (unless it is modified in accordance with the invention) is capable of being rendered to generate only speaker feeds for driving a subset of the set of loudspeakers (e.g., only those speakers in the set whose positions correspond to the subspace of the full three-dimensional volume). For example, the audio program may be capable of being rendered to generate only speaker feeds for driving the speakers in the set which are positioned in a horizontal plane including the listener's ears, where the subspace is said horizontal plane. The inventive rendering method implements upmixing by generating at least one speaker feed (in response to the modified program) for driving a speaker in the set whose position corresponds to a position outside the subspace, as well as generating speaker feeds for driving speakers in the set whose positions correspond to positions within the subspace. For example, a preferred embodiment of the method includes a step of generating speaker feeds in response to the modified program for driving all the loudspeakers of the set. Thus, the preferred embodiment leverages all speakers present in the playback system, whereas rendering of the original (unmodified) program would not generate speaker feeds for driving all the speakers of the playback system.

In other embodiments, the inventive method includes a step of modifying an object based audio program indicative of a trajectory of an audio object, to determine a modified program indicative of a modified trajectory of the object, where both the trajectory and the modified trajectory are defined in the same space (i.e., no portion of the modified trajectory extends outside the space in which the trajectory extends). For example, the trajectory may be modified to optimize (or otherwise modify) the timbre of sound emitted in response to speaker feeds determined from the modified program relative to the sound that would be emitted in response to speaker feeds determined from the original program (e.g., in the case that the modified trajectory, but not the original trajectory, determines a single ended "snap to" or "snap toward" a speaker).

In typical embodiments, the inventive method includes steps of distorting over time a trajectory of an authored object to determine a modified trajectory of the object, where the object's trajectory is indicated by an object based audio program and is within a subspace of a three-dimensional volume, and such that at least a portion of the modified trajectory is outside the subspace, and generating at least one speaker feed for a speaker whose position corresponds to a position outside the subspace (e.g., where the subspace is a horizontal plane at a first elevational angle relative to an expected listener, a speaker feed is generated for driving a speaker located at a second elevational angle relative to the listener, where the second elevational angle is different than the first elevational angle. For example, the first elevational angle may be zero and the second elevational angle may be nonzero). For example, the method may include a step of distorting an audio object's trajectory indicated by an object based audio program, where the trajectory is in a horizontal plane at an elevational angle of zero relative to the listener, in order to generate a speaker feed for a speaker (of a playback system) located at a nonzero elevational angle relative to a listener, where none of the speakers of the original authoring speaker system was located at a nonzero elevational angle relative to the content creator.

In some embodiments, the inventive method includes the step of modifying (upmixing) an object based audio program indicative of a trajectory of an audio object, where the trajectory is within a subspace of a full three-dimensional volume, to determine a modified program indicative of a modified trajectory of the object (e.g., by modifying coordinates of the program indicative of the trajectory, where such coordinates are determined by metadata included in the program), such that at least a portion of the modified trajectory is outside the subspace. Some such embodiments are implemented by a stand-alone system or device (an "upmixer"). The modified program determined by the upmixer's output is typically provided to a rendering system configured to generate speaker feeds (in response to the modified program) for driving a set of loudspeakers, typically including a speaker feed for driving at least one speaker in the set whose position corresponds to a position outside the subspace. Alternatively, some such embodiments of the inventive method are implemented by a rendering system which generates the modified program and generates speaker feeds (in response to the modified program) for driving a set of loudspeakers, typically including a speaker feed for driving at least one speaker in the set whose position corresponds to a position outside the subspace.

An example of the inventive method is the rendering of an audio program which includes an object channel indicative of a source which undergoes front to back panning (i.e., the source's trajectory is a horizontal line). The pan may have been authored on a traditional 5.1 speaker setup, with the content creator monitoring an amplitude pan between the center speaker and the two (left rear and right rear) surround speakers of the 5.1 speaker array. The exemplary embodiment of the inventive rendering method generates speaker feeds for reproducing the program over all the speakers of a 6.1 speaker system, including an overhead speaker (e.g., speaker Ts of FIG. 3) as well as speakers which comprise a 5.1 speaker array, including by generating an overhead (height) channel speaker feed. In response to the speaker feeds for all the speakers of the 6.1 array, the 6.1 array would emit sound perceived by the listener as emitting from the source while the source pans (i.e., is perceived as translating through the room) along a modified trajectory that is a bent version of the originally authored horizontal linear trajectory. The modified trajectory extends from the center speaker (its unmodified starting point) vertically upward (and horizontally backward) toward the overhead speaker and then back downward (and horizontally backward) toward its unmodified ending point (between the left rear and right rear surround speakers) behind the listener.

Typically, the playback system includes a set of loudspeakers, and the set includes a first subset of speakers at positions in a first space corresponding to positions in the subspace containing the object trajectory indicated by the audio program to be rendered (e.g., loudspeakers at positions nominally in a horizontal plane including the listener, where the subspace is a horizontal plane including the listener), and a second subset including at least one speaker, where each speaker in the second subset is at a position corresponding to a position outside the subspace. To determine the modified trajectory (which is typically but not necessarily a curved trajectory), the rendering method may determine a candidate trajectory. The candidate trajectory includes a start point in the first space (such that one or more speakers in the first subset can be driven to emit sound perceived as originating at the start point) which coincides with a start point of the object trajectory, an end point in the first space (such that one or more speakers in the first subset can be driven to emit sound perceived as originating at the end point) which coincides with an end point of the object trajectory, and at least one intermediate point corresponding to the position of a speaker in the second subset (such that, for each intermediate point, a speaker in the second subset can be driven to emit sound perceived as originating at said intermediate point). In some cases, the candidate trajectory is used as the modified trajectory.

In other cases, a distorted version of the candidate trajectory (determined by at least one distortion coefficient) is used as the modified trajectory. Each distortion coefficient's value determines a degree of distortion applied to the candidate trajectory. For example, in one embodiment, the projection of each intermediate point (along the candidate trajectory) on the first space defines an inflection point (in the first space) which corresponds to the intermediate point. The line (normal to the first space) between the intermediate point and the corresponding inflection point is referred to as a distortion axis for the intermediate point. A distortion coefficient (for each intermediate point), whose value indicates position along the distortion axis for the intermediate point, determines a modified version of the intermediate point. Using such a distortion coefficient for each intermediate point, the modified trajectory may be determined to be a trajectory which extends from the start point of the candidate trajectory, through the modified version of each intermediate point, to the end point of the candidate trajectory. Because the modified trajectory determines (with the audio content for the relevant object) each speaker feed for the relevant object channel, each distortion coefficient controls how close the rendered object will be perceived to get to the corresponding speaker (in the second subset) when the rendered object pans along the modified trajectory.

One may define the direction of arrival of sound from an audio source in terms of Azimuth and Elevation angles (Az, El), or in terms of an (x,y,z) unit vector. For example, in FIG. 1, the arrival direction of sound (at listener 1's ears) from source position S may be defined in terms of an (x,y,z) unit vector, where the x and y axes are as shown, and the z axis is perpendicular to the plane of FIG. 1, and the sound's arrival direction may also defined in terms of the Azimuth angle Az shown (e.g., with an Elevation angle, El, equal to zero).

Figure 2:
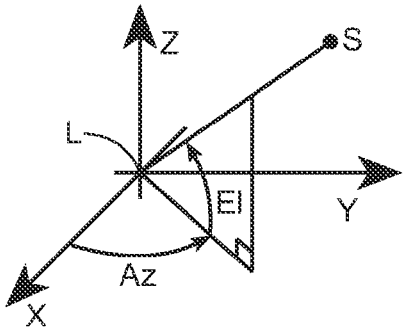
FIG. 2 is a diagram showing the definition of an arrival direction of sound (emitted from source position S) at location L, in terms of an (x,y,z) unit vector, and in terms of Azimuth angle Az and Elevation angle, El, in accordance with an embodiment of the invention.

FIG. 2 shows the arrival direction of sound (emitted from source position S) at location L (e.g., the location of a listener's ear), defined in terms of an (x,y,z) unit vector, where the x, y, and z axes are as shown, and in terms of Azimuth angle Az and Elevation angle, El.

An exemplary embodiment will be described with reference to FIGS. 3 and 4. In this embodiment, an object based audio program is rendered for playback on a system including a 6.1 speaker array. The speaker array includes a left front speaker L, a center front speaker, C, a right front speaker, R, a left surround (rear) speaker Ls, a right surround (rear) speaker Rs, and an overhead speaker, Ts. The left and right front speakers are not shown in FIG. 3 for clarity. The audio program is indicative of a source (audio object) which moves along a trajectory (the original trajectory shown in FIG. 3) in a horizontal plane including the expected listener's ears from the location of center speaker, C, positioned in front of the expected listener, to a location midway between the surround speakers, Rs and Ls, positioned behind the expected listener. For example, the audio program may include an object channel (which indicates the audio content emitted by the source) and metadata indicative of the object's trajectory (e.g., coordinates of the source, which are updated once per frame of the audio program).

The rendering system is configured to generate speaker feeds for driving all speakers of the 6.1 array (including the overhead speaker, Ts) in response to an object based audio program (e.g., the program in the example) which is not specifically indicative of audio content to be perceived as emitting from a location above the horizontal plane of the listener's ears. In accordance with the invention, the rendering system is configured to modify the original (horizontal) trajectory indicated by the program to determine a modified trajectory (for the same audio object) which extends from the location (point A) of the center speaker, C, upward and backward toward the location of the overhead speaker, Ts, and then downward and backward to the location (point B) midway between the surround speakers, Rs and Ls. Such a modified trajectory is also shown in FIG. 3. The rendering system is also configured to generate speaker feeds for driving all speakers of the 6.1 array (including the overhead speaker, Ts) to emit sound perceived as emitting from the object as it translates along the modified trajectory.

Figure 4:
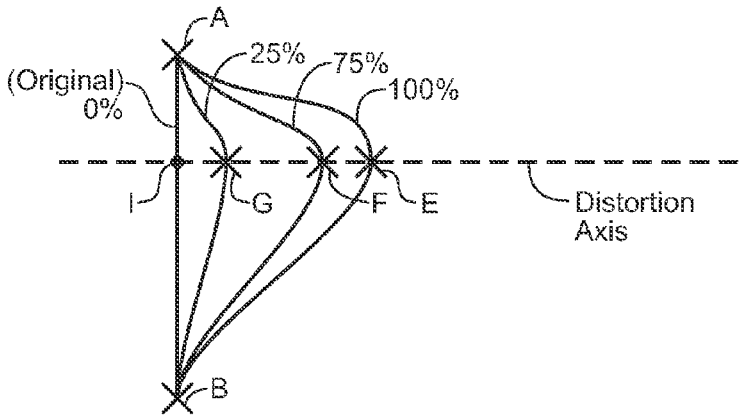
FIG. 4 is a diagram of the perceived trajectories of FIG. 3, and two additional trajectories that can be determined by speaker feeds generated (from an audio program comprising at least one object channel, but comprising no speaker channel) in accordance with an embodiment of the invention.

As shown in FIG. 4, the original trajectory determined by the program is a straight line from point A (the location of center speaker, C) to point B (the location midway between the surround speakers, Rs and Ls). In response to the original trajectory, the exemplary rendering method determines a candidate trajectory having the same start and end points as the original trajectory but passing through the location of the overhead speaker, Ts, which is the intermediate point identified as point E in FIG. 4.

The rendering system may use the candidate trajectory as the modified trajectory (e.g., in response to assertion of the below-described distortion coefficient with the value 100%, or in response to some other user-determined control value).

The rendering system is preferably also configured to use any of a set of distorted versions of the candidate trajectory as the modified trajectory (e.g., in response to the below-described distortion coefficient having some value other than 100%, or in response to some other user-determined control value). FIG. 4 shows two such distorted versions of the candidate trajectory (one for a distortion coefficient having the value 75%; the other for a distortion coefficient having the value 25%). Each distorted version of the candidate trajectory has the same start and end points as the original trajectory, but has a different point of closest approach to the location of the overhead speaker, Ts (point E in FIG. 4).

In the example, the rendering system is configured to respond to a user specified distortion coefficient having a value in the range from 100% (to achieve maximum distortion of the original trajectory, thereby maximizing use of the overhead speaker) to 0% (preventing any distortion of the original trajectory for the purpose of increasing use of the overhead speaker). In response to the specified value of the distortion coefficient, the rendering system uses a corresponding one of the distorted versions of the candidate trajectory as the modified trajectory. Specifically, the candidate trajectory is used as the modified trajectory in response to the distortion coefficient having the value 100%, the distorted candidate trajectory passing through point F (of FIG. 4) is used as the modified trajectory in response to the distortion coefficient having the value 75% (so that the modified trajectory will approach closely the point E), and the distorted candidate trajectory passing through point G (of FIG. 4) is used as the modified trajectory in response to the distortion coefficient having the value 25% (so that the modified trajectory will less closely approach point E).

In the example, the rendering system is configured to efficiently determine the modified trajectory so as to achieve a desired degree of use of the overhead speaker determined by the distortion coefficient's value. This can be understood by considering the distortion axis through points I and E of FIG. 4, which is perpendicular to the original linear trajectory (from point A to point B). The projection of intermediate point E (along the candidate trajectory) on the space (the horizontal plane including points A and B) through which the original trajectory extends defines an inflection point I in said space (i.e., in the horizontal plane including points A and B) corresponding to intermediate point E. Point I is an "inflection" point in the sense that it is the point at which the candidate trajectory ceases to diverge from the original trajectory and begins to approach the original trajectory. The line between intermediate point E and the corresponding inflection point I is the distortion axis for intermediate point E. The distortion coefficient's value (in the range from 100% to 0%) corresponds to distance along the distortion axis from the inflection point to the intermediate point, and thus determines the distance of closest approach of one of the distorted versions of the candidate trajectory (e.g., the one extending through point F) to the position of the overhead speaker. The rendering system is configured to respond to the distortion coefficient by selecting (as the modified trajectory) a distorted version of the candidate trajectory which extends from the start point of the candidate trajectory, through the point (along the distortion axis) whose distance from the inflection point is determined by the value of the distortion coefficient (e.g., point F, when the distortion coefficient value is 75%), to the end point of the candidate trajectory. Because the modified trajectory determines (with the audio content for the relevant object) each speaker feed for the relevant object channel, the distortion coefficient's value thus controls how close to the overhead speaker the rendered object will be perceived to get when the rendered object pans along the modified trajectory.

The intersection of each distorted version of the candidate trajectory with the distortion axis is the inflection point of said distorted version of the candidate trajectory. Thus, point G of FIG. 4, the intersection of the distorted candidate trajectory determined by the distortion coefficient value 25% with the distortion axis, is the inflection point of said distorted candidate trajectory.

In a class of embodiments, the inventive rendering system is configured to determine, from an object based audio program (and knowledge of the positions of the speakers to be employed to play the program), the distance between each position of an audio source indicated by the program and the position of each of the speakers. Desired positions of the source can be defined relative to the positions of the speakers (e.g., it may be desired to play back sound so that the sound will be perceived as emitting from one of the speakers, e.g. an overhead speaker), and the source positions indicated by the program can be considered to be actual positions of the source. The system is configured in accordance with the invention to determine, for each actual source position (e.g., each source position along a source trajectory) indicated by the program, a subset of the full set of speakers (a "primary" subset) consisting of those speakers of the full set which are (or the speaker of the full set which is) closest (in some reasonably defined sense) to the source position. Typically, speaker feeds are generated (for each source position) which cause sound to be emitted with relatively large amplitudes from the speaker(s) of the primary subset (for the source position) and with relatively smaller amplitudes (or zero amplitudes) from the other speakers of the playback system. The speaker(s) of the full set which are (or is) "closest" to a source position may be each speaker whose position in the playback system corresponds to a position (in the three dimensional volume in which the source trajectory is defined) whose distance from the source position is within a predetermined threshold value, or whose distance from the source position satisfies some other predetermined criterion.

A sequence of source positions indicated by the program (which can be considered to define a source trajectory) determines a sequence of primary subsets of the full set of speakers (one primary subset for each source position in the sequence).

The positions of the speakers in each primary subset define a three-dimensional (3D) space which contains each speaker of the primary subset and a position corresponding to the relevant source position, but which contains no other speaker of the full set. Each such position which "corresponds" to an actual source position is a position, in the actual playback system, which "corresponds" to the source position in the sense that the content creator intends that sound emitted from the speakers of the playback system should be perceived by a listener as emitting from said source position. Thus, for convenience, such a position in the playback system which "corresponds" to a source position will sometimes be referred to as an actual source position, where it is clear from the context that it is a position in an actual playback system (e.g., a 3D space including a primary subset of a set of speakers, which is a space in a playback system of the type mentioned above in this paragraph, will sometimes be referred to as a 3D space including the source position which corresponds to the primary subset). For example, consider the 6.1 speaker array of FIG. 3, which is positioned in a room having rectangular volume V, and which is to be employed to render a program indicative of the "original trajectory" indicated in FIG. 3. In this example, the primary subset for the first point (the location of speaker C) of the original trajectory may comprise the front speakers (C, R, and L) of the 6.1 speaker array, and the 3D space containing this primary subset may be a rectangular volume whose width is the distance from the R to the L speaker), whose length is the depth (from front to back) of the deepest one of the R, L, and S speakers, and whose height is the expected elevation (above the floor) of the listener's ears (assuming that the R, L, and S speakers are positioned so as not to extend above this height). The primary subset for the midpoint of the original trajectory shown in FIG. 3 (the point along the trajectory which is vertically below the center of overhead speaker Ts of the 6.1 array) may comprise only the overhead speaker Ts, and the 3D space containing this primary subset may be rectangular volume V' (of FIG. 3) whose width is the room width (the distance from the Rs to the Ls speaker), whose length is the width of the Ts speaker, and whose height is the room height.

The steps of determining a modified trajectory (in response to a source trajectory indicated by the program) and generating speaker feeds (for driving all speakers of the playback system) in response to the modified trajectory, can thus be implemented in the exemplary rendering system as follows: for each of the sequence of source positions indicated by the program (which can be considered to define a trajectory, e.g., the "original trajectory" of FIG. 3), speaker feeds are generated for driving the speakers of corresponding primary subset (included in the 3D space for the source position), and the other speakers of the full set, to emit sound intended to be perceived (and which typically will be perceived) as being emitted by the source from a characteristic point of the 3D space (e.g., the characteristic point may be the intersection of the top surface of the 3D space with a vertical line through the source position determined by the program). Considering the sequence of 3D spaces so determined from an object based audio program, and identifying the characteristic point of each of the 3D spaces in the sequence, a curve that is fitted through all or some of the characteristic points can be considered to define a modified trajectory (determined in response to the original trajectory indicated by the program).

Optionally, a scaling parameter is applied to each of the 3D spaces (which are determined in accordance with an embodiment in the noted class) to generate a scaled space (sometimes referred to herein as a "warped" space) in response to the 3D space, and speaker feeds are generated for driving the speakers (of the full set employed to play the program) to emit sound intended to be perceived (and which typically will be perceived) as being emitted by the source from a characteristic point of the warped space rather than from the above-noted characteristic point of the 3D space (e.g., the characteristic point of the warped space may be the intersection of the top surface of the warped space with a vertical line through the source position determined by the program). Warping of a 3D space is a relatively simple, well known mathematical operation. In the example described with reference to FIG. 3, the warping could be implemented as a scale factor applied to the height axis. Thus, the height of each warped space is a scaled version of the height of the corresponding 3D space (and the length and width of each warped space matches the length and width of the corresponding 3D space).

Figure 3:
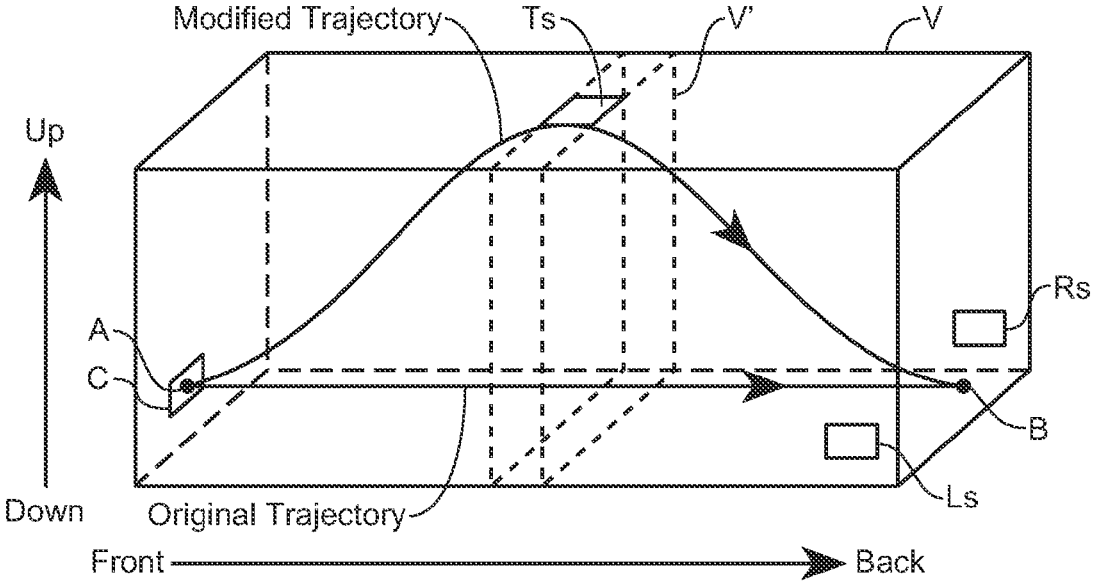
FIG. 3 is a diagram of speakers of a loudspeaker array driven by speaker feeds generated (from an audio program comprising at least one object channel, but comprising no speaker channel) in accordance with an embodiment of the invention, showing perceived trajectories of an object determined by the speaker feeds.

For example, a scaling parameter of "0.0" could maximize the height of the warped space (e.g., the warped space determined by applying such a scaling parameter of 0.0 to volume V' of FIG. 3 would be identical to the volume V'). This would result in "100% distortion" of the original trajectory without any need for the rendering system to determine an inflection point or implement look ahead. In the example, a scaling parameter, X, in the range from 0.0 to 1.0 could cause the height of the warped space to be less than that of the corresponding 3D space (e.g., the warped space determined by applying a scaling parameter of X=0.5, to volume V' of FIG. 3, could be the lower half of the volume V', having height equal to half the room height). Thus, application of such a scaling parameter in the range from 0.0 to 1.0 would result in less distortion of the original trajectory (also without any need for the rendering system to determine an inflection point or implement look ahead). Optionally, a scaling parameter, X, having value greater than 1.0 could result in compression of the corresponding dimension of the positional metadata of the program (e.g., for a source position indicated by the program which is near the top of the room, the characteristic point of the warped space determined by applying a scaling parameter of X=1.5 to the corresponding 3D space could be farther from the top of the room than is the characteristic point of the corresponding 3D space).

Some embodiments of the inventive method implement both audio object trajectory modification and rendering in a single step. For example, the rendering could implicitly distort (modify) a trajectory (of an audio object) determined by an object based audio program (to determine a modified trajectory for the object) by explicit generation of speaker feeds for speakers having distorted versions of known positions (e.g., by explicit distortion of known loudspeaker positions). The distortion could be implemented as a scale factor applied to an axis (e.g., a height axis). For example, application of a first scale factor (e.g., a scale factor equal to 0.0) to the height axis of a trajectory (e.g., the original trajectory shown in FIG. 3) during generation of speaker feeds could cause a modified trajectory of the object to intersect the position of an overhead speaker (resulting in "100% distortion"), so that the sound emitted from the speakers of the playback system in response to the speaker feeds would be perceived as emitting from a source whose (modified) trajectory includes the location of the overhead speaker. Application of a second scale factor (e.g., a scale factor greater than 0.0 but not greater than 1.0) to the height axis of the trajectory during generation of the speaker feeds could cause the modified trajectory to approach (but not intersect) the position of the overhead speaker more closely than does the original trajectory (resulting in "X % distortion," where the value of X is determined by the value of the scale factor), so that the sound emitted from the speakers of the playback system in response to the speaker feeds would be perceived as emitting from a source whose (modified) trajectory approaches (but does not include) the location of the overhead speaker. Application of a third scale factor (e.g., a scale factor greater than 1.0) to the height axis of the trajectory during generation of speaker feeds could cause the modified trajectory to diverge from the position of the overhead speaker (farther than the original trajectory does). Such combined trajectory modification and speaker feed generation can be implemented without any need to determine an inflection point, or to implement look ahead.

In some embodiments, the inventive system is or includes a general or special purpose processor programmed with software (or firmware) and/or otherwise configured to perform an embodiment of the inventive method. In some embodiments, the inventive system is or includes a general purpose processor, coupled to receive input audio (and optionally also input video), and programmed to generate (by performing an embodiment of the inventive method) output data (e.g., output data determining speaker feeds) in response to the input audio. For example, the system (e.g., system 3 of FIG. 5, or elements 4 and 5 of FIG. 6) may be implemented as an AVR, which also generates speaker feeds determined by the output data. In other embodiments, the inventive system (e.g., system 3 of FIG. 5, or elements 4 and 5 of FIG. 6) is or includes an appropriately configured (e.g., programmed and otherwise configured) audio digital signal processor (DSP) which is operable to generate output data (e.g., output data determining speaker feeds) in response to input audio.

In some embodiments, the inventive system is or includes a general or special purpose processor (e.g., an audio digital signal processor (DSP)), coupled to receive input audio data (indicative of an object based audio program) and programmed with software (or firmware) and/or otherwise configured to generate output data (a modified version of source position metadata indicated by the program, or data determining speaker feeds for rendering a modified version of the program) in response to the input audio data by performing an embodiment of the inventive method. The processor may be programmed with software (or firmware) and/or otherwise configured (e.g., in response to control data) to perform any of a variety of operations on the input audio data, including an embodiment of the inventive method.

Figure 5:
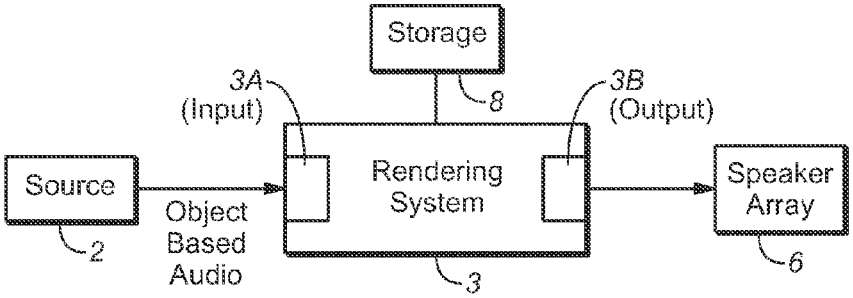
FIG. 5 is a block diagram of a system, including rendering system 3 (which is or includes a programmed processor) configured to perform an embodiment of the inventive method.

The FIG. 5 system includes audio delivery subsystem 2, which is configured to store and/or deliver audio data indicative of an object based audio program. The system of FIG. 5 also includes rendering system 3 (which is or includes a programmed processor), which is coupled to receive the audio data from subsystem 2 and configured to perform an embodiment of the inventive rendering method on the audio data. Rendering system 3 is coupled to receive (at at least one input 3A) the audio data, and programmed to perform any of a variety of operations on the audio data, including an embodiment of the inventive rendering method, to generate output data indicative of speaker feeds generated in accordance with the rendering method. The output data (and speaker feeds) are indicative of a modified version of the original program determined by the rendering method. The output data (or speaker feeds determined therefrom) are asserted (at at least one output 3B) from system 3 to speaker array 6, and speaker array 6 plays the modified version of the original program in response to speaker feeds received from system 3 (or speaker feeds generated in response to output data from system 3). A conventional digital-to-analog converter (DAC), included in system 3 or in array 6, could operate on the output data generated by system 3 to generate analog speaker feeds for driving the speakers of array 6.

Figure 6:
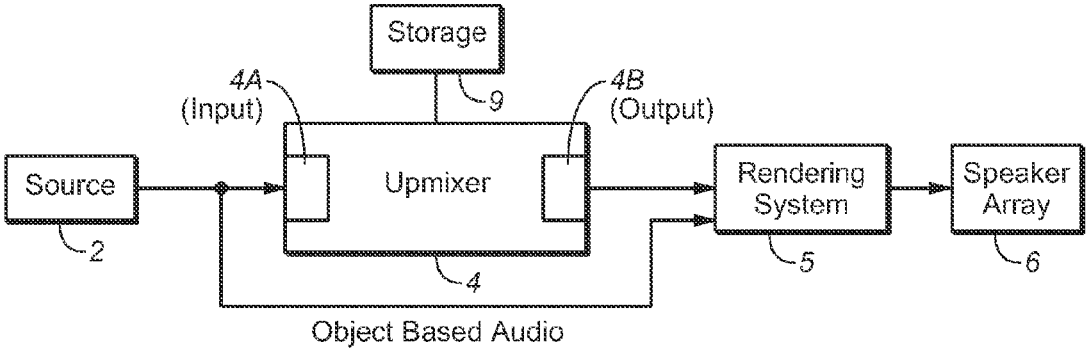
FIG. 6 is a block diagram of a system, including upmixer 4 (implemented as a programmed processor) configured to perform an embodiment of the inventive method.

The FIG. 6 system includes subsystem 2 and speaker array 6, which are identical to the identically numbered elements of the FIG. 5 system. Audio delivery subsystem 2 is configured to store and/or deliver audio data indicative of an object based audio program. The system of FIG. 6 also includes upmixer 4, which is coupled to receive the audio data from subsystem 2 and configured to perform an embodiment of the inventive method on the audio data (e.g., on source position metadata included in the audio data). Upmixer 4 is coupled to receive (at at least one input 4A) the audio data, and is programmed to perform an embodiment of the inventive method on the audio data (e.g., on source position metadata of the audio data) to generate (and assert at at least one output 4B) output data which determine (with the original audio data from subsystem 2) a modified version of the program (e.g., a modified version of the program in which source position metadata indicated by the program are replaced by modified source position data generated by upmixer 4). Upmixer 4 is configured to assert the output data (at at least one output 4B) to rendering system 5. System 5 is configured to generate speaker feeds in response to the modified version of the program (as determined by the output data from upmixer 4 and the original audio data from subsystem 2), and to assert the speaker feeds to speaker array 6. Speaker array 6 is configured to play the modified version of the original program in response to the speaker feeds.

More specifically, a typical implementation of upmixer 4 is programmed to modify (upmix) the object based audio program (which is indicative of a trajectory of an audio object and the trajectory is within a subspace of a full three-dimensional volume) determined by the audio data from subsystem 2, in response to source position metadata of the program to generate (and assert at at least one output 4B) output data which determine (with the original audio data from subsystem 2) a modified version of the program. For example, upmixer 4 may be configured to modify the source position metadata of the program to generate output data indicative of modified source position data which determine a modified trajectory of the object, such that at least a portion of the modified trajectory is outside the subspace. The output data (with the audio content of the object, included in the original audio data from subsystem 2) determine a modified program indicative of the modified trajectory of the object. In response to the modified program, rendering system 5 generates speaker feeds for driving the speakers of array 6 to emit sound that will be perceived as being emitted by the object as it translates along the modified trajectory.

For another example, upmixer 4 may be configured to generate (from the source position metadata of the program) output data indicative of a sequence of characteristic points (one for each of the sequence of source positions indicated by the program), each of the characteristic points being in one of a sequence of 3D spaces (e.g., scaled 3D spaces of the type described above with reference to FIG. 3), where each of the 3D spaces corresponds to one of the sequence of source positions indicated by the program. In response to this output data (and the audio content of the source, as included in the original audio data from subsystem 2), rendering system 5 generates speaker feeds for driving the speakers of array 6 to emit sound that will be perceived as being emitted by the source from said sequence of characteristic points of the sequence of 3D spaces.

The system of FIG. 5 optionally includes storage medium 8, coupled to rendering system 3. Computer readable storage medium 8 (e.g., an optical disk or other tangible object) has computer code stored thereon that is suitable for programming system 3 (implemented as a processor), or a processor included in system 3, to perform an embodiment of the inventive method. In operation, the processor executes the computer code to process data in accordance with the invention to generate output data.

Similarly, the system of FIG. 6 optionally includes storage medium 9, coupled to upmixer 4. Computer readable storage medium 9 (e.g., an optical disk or other tangible object) has computer code stored thereon that is suitable for programming upmixer 4 (implemented as a processor) to perform an embodiment of the inventive method. In operation, the processor executes the computer code to process data in accordance with the invention to generate output data.

In the case that the inventive system (either a rendering system, e.g., system 3 of FIG. 5, or an upmixer, e.g., upmixer 4 of FIG. 6, for generating a modified program for rendering by a rendering system) is configured to process content in a non-real-time manner, it is useful to include metadata in the object based audio program to be rendered, where the metadata indicates both the starting and finishing points for each object trajectory indicated by the program. Preferably, the system is configured to use such metadata to implement upmixing (to determine a modified trajectory for each such trajectory) without need for look-ahead delays. Alternatively, the need for look-ahead delays could be eliminated by configuring the inventive system to average over time the coordinates of an object trajectory (indicated by an object based audio program to be rendered) to generate a trajectory trend and to use such averages to predict the path of the trajectory and find each inflection point of the trajectory.

Additional metadata could be included in an object based audio program, to provide to the inventive system (either a system configured to render the program, e.g., system 3 of FIG. 5, or an upmixer, e.g., upmixer 4 of FIG. 6, for generating a modified version of the program for rendering by a rendering system) information that enables the system to override a coefficient value or otherwise influences the system's behavior (e.g., to prevent the system from modifying the trajectories of certain objects indicated by the program). For example, if the metadata is indicative of a characteristic (e.g., a type or a property) of an audio object, the system is preferably configured to operate in a specific mode in response to the metadata (e.g., a mode in which it is prevented from modifying the trajectory of an object of a specific type). For example, the system could be configured to respond to metadata indicating that an object is dialog, by disabling upmixing for the object (e.g., so that speaker feeds will be generated using the trajectory, if any, indicated by the program for the dialog, rather than from a modified version of the trajectory, e.g., one which extends above or below the horizontal plane of the intended listener).

Upmixing in accordance with the invention can be directly applied to an object based audio program whose content was object audio from the beginning (i.e., which was originally authored as an object based program). Such upmixing can also be applied to content that has been "objectized" (i.e., converted to an object based audio program) through the use of a source separation upmixer. A typical source separation upmixer would apply analysis and signal processing to content (e.g., an audio program including only speaker channels; not object channels) to separate individual tracks (each corresponding to audio content from an individual audio object) that had been mixed together to generate the content, thereby determining an object channel for each individual audio object.

Aspects of the invention include a system (e.g., an upmixer or a rendering system) configured (e.g., programmed) to perform any embodiment of the inventive method, and a computer readable medium (e.g., a disc or other tangible object) which stores code for implementing any embodiment of the inventive method.

In some embodiments of the inventive method, some or all of the steps described herein are performed simultaneously or in a different order than specified in the examples described herein. Although steps are performed in a particular order in some embodiments of the inventive method, some steps may be performed simultaneously or in a different order in other embodiments.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for rendering an object based audio program for playback by a speaker set, wherein the object based audio program comprises an object channel, wherein the object based audio program comprises metadata which is indicative of a trajectory of an audio object determined by the object channel of the object based audio program, wherein the trajectory is defined by a sequence of time-varying source positions of the audio object, wherein the sequence of time-varying source positions is indicated by the metadata, wherein the trajectory is within a subspace of a three-dimensional volume, wherein the object based audio program comprises audio data for the audio object, wherein each speaker in the speaker set has a known position in a playback system, the speaker set includes a first subset of speakers at positions in a first space of the playback system corresponding to positions in the subspace containing the trajectory, the speaker set also includes a second subset including at least one speaker, and each speaker in the second subset is at a position in the playback system corresponding to a position outside the subspace, said method including the steps of:

(a) modifying the program, using an upmixer, to determine a modified program comprising modified metadata indicative of a modified trajectory of the object, wherein the modified trajectory is defined by a sequence of time-varying modified source positions of the audio object, where at least a portion of the modified trajectory is outside the subspace; wherein the modified trajectory includes a start point in the first space which coincides with a start point of the trajectory, an end point in the first space which coincides with an end point of the trajectory, and at least one intermediate point corresponding to the position of a speaker in the second subset; and (b) generating speaker feeds in response to the modified program comprising the modified metadata and the audio data for the audio object, such that the speaker feeds include at least one feed for driving at least one speaker in the speaker set whose position corresponds to a position outside the subspace, and feeds for driving speakers in the speaker set whose positions correspond to positions within the subspace;

wherein step (a) includes steps of:

for each modified source position in the sequence of modified source positions, determining a distance between the modified source position and the position of each speaker in the speaker set; and for each modified source position in the sequence of modified source positions, determining a primary subset of the speaker set, said primary subset consisting of each speaker of the speaker set which is closest to the modified source position;

wherein the method further comprises:

determining, for each said primary subset, a three-dimensional space which contains each speaker of the primary subset and the modified source position for said primary subset but contains no other speaker of the speaker set, wherein step (b) includes the step of generating, for each modified source position in the sequence of modified source positions, at least one speaker feed for driving each speaker of the primary subset for said modified source position, and at least one other speaker feed for driving each other speaker of the speaker set; and in response to the speaker feeds generated for said each modified source position, driving the speaker set to emit sound intended to be perceived as being emitted by the audio object from a characteristic point of the three-dimensional space which contains said modified source position.

2. The method of claim 1, wherein the speaker feeds generated in step (b) include speaker feeds for driving all the speakers of the speaker set.

3. The method of claim 1, wherein the metadata included in the program determines coordinates of the trajectory, and step (a) includes the step of modifying said coordinates.

4. The method of claim 1, wherein the primary subset for each source position consists of each speaker in the speaker set whose position in the playback system corresponds to a position, in the three-dimensional volume in which the trajectory is defined, whose distance from the source position is within a predetermined threshold value.

5. The method of claim 1, further comprising for each modified source position in the sequence of modified source positions, applying a scaling parameter to the three-dimensional space containing the modified source position to generate a scaled space which contains said modified source position.

6. The method of claim 5, wherein application of the scale parameter to each said three-dimensional space includes application of the scale parameter to a height axis of the three-dimensional space.

7. The method of claim 1, wherein the speaker feeds generated in step (b) include speaker feeds for driving all the speakers of the speaker set.

8. The method of claim 1, wherein the subspace is a horizontal plane at a first elevational angle relative to an expected listener, and step (b) includes a step of generating a speaker feed for a speaker in the set which is located at a second elevational angle relative to the expected listener, where the second elevational angle is different than the first elevational angle.

9. The method of claim 1, wherein said method includes steps of:

determining a candidate trajectory which includes a start point in the first space which coincides with the start point of the trajectory, an end point in the first space which coincides with the end point of the trajectory, and at least one intermediate point corresponding to the position of a speaker in the second subset; and distorting the candidate trajectory by applying at least one distortion coefficient thereto, thereby determining a distorted candidate trajectory, wherein the distorted candidate trajectory is the modified trajectory.

10. The method of claim 9, wherein a projection of each said intermediate point on the first space defines an inflection point in the first space which corresponds to the intermediate point, wherein a line normal to the first space between each said intermediate point and the corresponding inflection point is a distortion axis for the intermediate point, and wherein each said distortion coefficient has a value indicating a position along the distortion axis for one said intermediate point.

11. A system for rendering an object based audio program for playback by a speaker set, where each channel of the program is an object channel, the program is indicative of a trajectory of an audio object, and the trajectory is within a subspace of a three-dimensional volume, said system including:

an upmixing subsystem configured to modify the program to determine a modified program indicative of a modified trajectory of the object, where at least a portion of the modified trajectory is outside the subspace; and a speaker feed subsystem coupled and configured to generate speaker feeds in response to the modified program, such that the speaker feeds include at least one feed for driving at least one speaker in the speaker set whose position corresponds to a position outside the subspace, and feeds for driving speakers in the speaker set whose positions correspond to positions within the subspace.

12. The system of claim 11, wherein the speaker feed subsystem is configured to generate speaker feeds, in response to the modified program, for driving all the speakers of the speaker set.

13. The system of claim 11, wherein metadata included in the program determines coordinates of the trajectory, and the upmixing subsystem is configured to modify said coordinates.

14. The system of claim 11, wherein a sequence of source positions indicated by the program defines the trajectory, and the upmixing subsystem is configured to:

determine, for each source position in the sequence of source positions, a distance between the source position and the position of each speaker in the speaker set; and determine, for each source position in the sequence of source positions, a primary subset of the speaker set, said primary subset consisting of each speaker of the speaker set which is closest to the source position.

15. The system of claim 14, wherein each speaker in the speaker set has a known position in a playback system, and the primary subset for each source position consists of each speaker in the speaker set whose position in the playback system corresponds to a position, in the three-dimensional volume in which the trajectory is defined, whose distance from the source position is within a predetermined threshold value.

16. The system of claim 14, wherein the upmixing subsystem is configured to determine, for each said primary subset, a three-dimensional space which contains each speaker of the primary subset and the source position for said primary subset but contains no other speaker of the speaker set, and the speaker feed subsystem is configured to generate the speaker feeds such that, in response to the speaker feeds generated for said each source position, the speaker set emits sound intended to be perceived as being emitted by the source from a characteristic point of the three-dimensional space which contains said source position.

17. The system of claim 14, wherein the upmixing subsystem is configured to determine, for each said primary subset, a three-dimensional space which contains each speaker of the primary subset and the source position for said primary subset but contains no other speaker of the speaker set, and to apply, for each source position in the sequence of source positions, a scaling parameter to the three-dimensional space containing the source position to generate a scaled space which contains said source position, and the speaker feed subsystem is configured to generate the speaker feeds such that, in response the speaker feeds generated for each source position, the speaker set emits sound intended to be perceived as being emitted by the source from a characteristic point of the scaled space which contains said source position.

18. The system of claim 17, wherein the upmixing system is configured to apply the scaling parameter to a height axis of each said three-dimensional space.

19. The system of claim 11, wherein the subspace is a horizontal plane at a first elevational angle relative to an expected listener, and the speaker feed subsystem is configured to generate the speaker feeds in response to the modified program, such that said speaker feeds include a speaker feed for a speaker in the set which is located at a second elevational angle relative to the expected listener, where the second elevational angle is different than the first elevational angle.

20. The system of claim 11, wherein each speaker in the speaker set has a known position in a playback system, the speaker set includes a first subset of speakers at positions in a first space of the playback system corresponding to positions in the subspace containing the trajectory, the speaker set also includes a second subset including at least one speaker, each speaker in the second subset is at a position in the playback system corresponding to a position outside the subspace, and the modified trajectory includes:

a start point in the first space which coincides with a start point of the trajectory, an end point in the first space which coincides with an end point of the trajectory, and at least one intermediate point corresponding to the position of a speaker in the second subset.

21. The system of claim 11, wherein each speaker in the speaker set has a known position in a playback system, the speaker set includes a first subset of speakers at positions in a first space of the playback system corresponding to positions in the subspace containing the trajectory, the speaker set also includes a second subset including at least one speaker, each speaker in the second subset is at a position in the playback system corresponding to a position outside the subspace, and the upmixing subsystem is configured:

to determine a candidate trajectory which includes a start point in the first space which coincides with a start point of the trajectory, an end point in the first space which coincides with an end point of the trajectory, and at least one intermediate point corresponding to the position of a speaker in the second subset; and to distort the candidate trajectory by applying at least one distortion coefficient thereto, thereby determining a distorted candidate trajectory, wherein the distorted candidate trajectory is the modified trajectory.

22. The system of claim 21, wherein a projection of each said intermediate point on the first space defines an inflection point in the first space which corresponds to the intermediate point, wherein a line normal to the first space between each said intermediate point and the corresponding inflection point is a distortion axis for the intermediate point, and wherein each said distortion coefficient has a value indicating position along the distortion axis for one said intermediate point.

23. The system of claim 11, wherein the program includes metadata indicative of a starting point and a finishing point for the trajectory, and wherein the upmixing subsystem is configured to determine the modified trajectory using the metadata without implementing a look-ahead delay.

24. The system of claim 11, wherein the program includes metadata indicative of at least one characteristic of the audio object, and the upmixing subsystem is configured to operate in a mode determined by the metadata.

25. The system of claim 24, wherein the metadata indicates that the object is dialog.

26. The system of claim 11, wherein the upmixing subsystem is an audio digital signal processor.

27. The system of claim 11, wherein the upmixing subsystem is a processor that has been programmed to generate output data indicative of the modified program in response to input data indicative of the program.

* * * * *